United States Patent [19]

Schwarz

[11] Patent Number: 4,546,718

[45] Date of Patent: Oct. 15, 1985

[54] SAILING SHIP

[75] Inventor: Hartmut B. Schwarz, Norderstedt, Fed. Rep. of Germany

[73] Assignee: Bremer Vulkan AG Schiffbau Und Maschinenfabrik, Bremen, Fed. Rep. of Germany

[21] Appl. No.: 606,288

[22] Filed: May 2, 1984

[30] Foreign Application Priority Data

May 3, 1983 [DE] Fed. Rep. of Germany ..... 3316139

[51] Int. Cl.[4] ..... B63B 35/00

[52] U.S. Cl. ..... 114/39; 114/89; 114/104

[58] Field of Search ..... 114/89–92, 114/97–98, 102–109, 39

[56] References Cited

U.S. PATENT DOCUMENTS 3,085,539 4/1963 Prolss ..... 114/89

OTHER PUBLICATIONS

"Cargoes Under Sail", *Ship and Harbor Bridges,* Dec. 1980, pp. 35–37.

*Primary Examiner*—Jesus D. Sotelo

*Attorney, Agent, or Firm*—Prutzman, Kalb, Chilton & Alix

[57] ABSTRACT

A sailing ship (1) has at least one mast (2,3,4) rigidly attached thereto, to which the yards (5 to 9) are rotatably attached. By an actuating shaft (21), the sail (22, 22*a,* 22*b*) can be reefed and, with the aid of a corresponding rope (24), it can be erected or stretched. The sail (22, 22*a,* 22*b*) is narrower in the middle than at the edges and has upper and lower boltropes (48, 49) that are guided in grooves (27) to the yards (5–9). Erecting and reefing of the sail (22, 22*a,* 22*b*) and bracing can be accomplished by remote control. Because of the high speed that can be attained, energy recovery is possible with a propeller.

15 Claims, 9 Drawing Figures

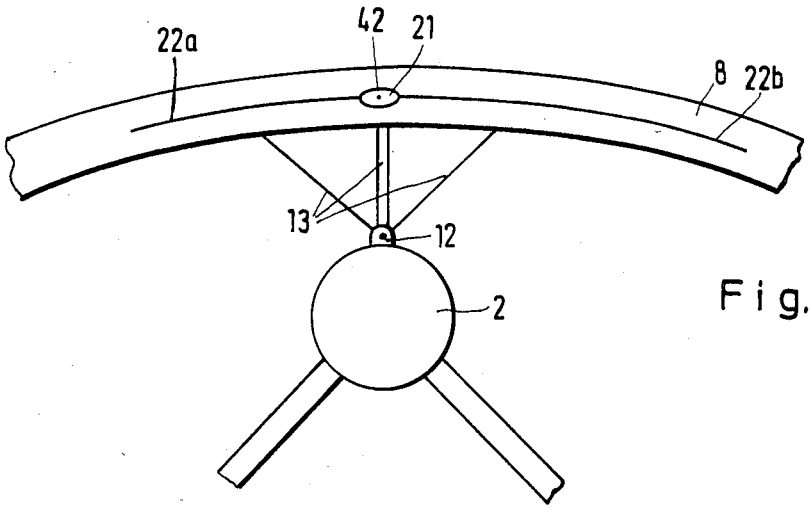
Fig.3
Fig.4
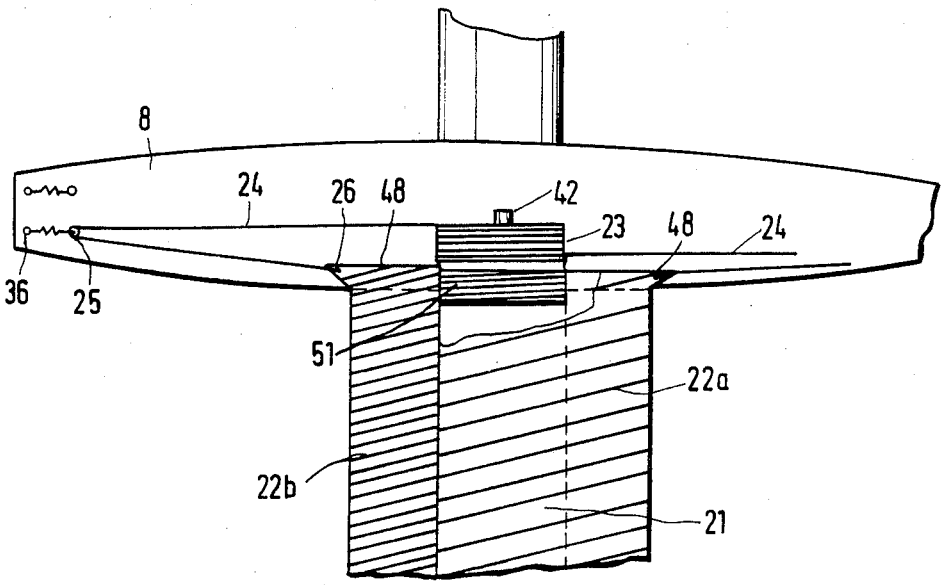

SAILING SHIP

DESCRIPTION

The present invention relates to a sailing ship with at least one mast and a number of curved yards pivotally mounted on the mast in overlying relationship and pivotally adjusted by means of bracing devices. An actuating shaft for reefing the spread out sails is arranged in the center section of the yards between every two yards, with each half of the sail attached on dimetrically opposite sides. The outer upper and lower corners of the sails are attached by wires, ropes or the like that run generally in the direction of the longitudinal dimension of the yards and by which the sail can be erected by being pulled outwardly.

A sailing ship of this type is disclosed in the published Japanese patent application No. 56-63595. In that application, the yards are secured to a shaft which is attached to a mast so that they can be pivoted by turning the shaft. The disadvantage of such a device is that it can only be used on small ships since very high wind velocities will cause considerable force to be transmitted to the shaft. Additionally, the sails are apparently attached to perpendicular, rigid components, such as shafts for rolling up the sails and to a corresponding outer part which is moveable in the longitudinal direction of the yards. Because of its attachment components, the sails bulge and cannot be adapted to various wind conditions.

Accordingly, one purpose of the invention is to provide a sailing ship having sails which are especially beneficial under all kinds of wind conditions and which are also suitable for large ships. More specifically, the purpose of this invention is to provide a sailing ship which can be sailed higher in the wind than the known yard gliders and which has the advantageous maneuverability of the modern yard.

According to the invention, the upper and lower boltropes of the sail are held in grooves of the yard and the sail is not as wide and not as high in the middle as it is on the outside between the corners. The vertical spacing of the yards varies correspondingly, and the mast is of tripod configuration, having three struts attached to one another with two of the struts arranged transversely to the ship's longitudinal axis near one another and the third arranged in the middle and in front of the first two. The yards are pivotally attached to the third strut and bracing devices in the form of ropes and cables are attached to the yards and the first two struts.

The upper and lower boltropes of the sail are held in the grooves of the yards while the outer boltropes are free and not held rigidly, so that the convex shape of the sail is not restrained. Moreover, the ends of the yards taper so that in the end area the vertical yard spacing is greater than in the middle thereby corresponding to the sails that are narrower in the middle and not as high inside as outside. Since the wires or ropes, with which the sail can be spread out, follow essentially the longitudinal extension of the yards, the sail is not merely pulled and held by the ropes. Rather, the upper and outer corners of the sail are pulled up and the lower outer corners are pulled down so that not only the upper and lower boltropes are stretched, but also the outer or end boltropes. In this way, more or less uniform tensile stress is transmitted to the entire sail which leads to very favorable qualities in the sail.

Moreover, the corresponding spacing of guide pulleys on the yards should be guaranteed in the cam area so that the sail does not touch the guide pulley as otherwise it cannot be properly stretched. If these guide pulleys lie far enough outwardly on the yards, the outer boltrope will also be stretched better, which is critical for the windward boltrope when sailing in the wind.

Contrary to the previously mentioned sailing ship, a tripod mast is also employed. Struts with ropes or wires extend from the mast in the cross direction of the ship as bracing devices to the yard, so that the transmitted energy from the wind can be better absorbed on the sail and the yards than is the case in the device of the above-mentioned application. Also the bending of the yards, as is to be expected in this device because the wind pressure is avoided by these wires or ropes, contributes to the favorable sail qualities. The tripod mast and the special bracing device are known from the article "Cargoes under Sail—no Topic in Germany" in the periodical "Ship and Harbor Bridges", December 1980, Part 12, Pages 35–37, especially from the drawing on page 35.

According to the invention, the sailing ship can be sailed in very high wind. A bracing angle up to 20 degrees is possible, while in traditional yard gliders a bracing of only up to 66 degrees is possible. In this way, according,to the present invention the sailing ship attains essentially a higher speed in the wind, and for the first time also enables a recovery of energy or, as the case may be, the production of electrical energy which can be used for starting in calm waters or for the operation of the ships auxiliary devices, air conditioning, etc.

The shaft upon which the sail can be rolled up for reefing can have, for example, a circular cross section. However, according to the invention, the shaft has essentially an elliptical cross section whereby the large principal axis of the ellipse is parallel to the tangential direction of the curved yards at the location of the shaft. In this way, the shaft offers only a slight resistance to the wind due to its elliptical cross section. Nevertheless, the sail can be quickly rolled up on the shaft. By a corresponding design, it is possible to build the device so that only ten, or at the most twelve, turns of the shaft are necessary in order to completely roll up the sail.

In the construction of the prior art, two different drives are provided; namely, one for reefing and one for erecting the sail. The construction as provided by the invention is simpler since the wires, ropes or the like for erecting the sail are attached to a cylinder fixedly connected with the shaft so that they are rolled up when the sails are rolled up and vice verse and whereby they are stretched by the flexible components.

If the sail is reefed or erected, the boltropes move in the grooves of the yard. The boltropes are not locked in the grooves and the grooves do not have essentially a round cross section through which a ropes are extended and around which the sail is sewn. Rather according to the invention it is provided that the boltropes which are held in the grooves of the yard have an elongated cross section, whereby the greatest longitudinal extension of the cross section is perpendicular to the surface of the sail.

By this method, an essentially easier erection and reefing of the sail is possible. Such an erecting and reefing is without problems and permits many functions of the sailing ship to be done by remote control.

According to the invention, the boltropes which are held in the grooves of the yard can be formed from an open link chain with alternating links extending perpendicular to each other, whereby the sail is attached to every other link. Accordingly, every second link has the large extension perpendicular to the sail surface for locking the boltrope in the undercut groove of the yard while the intermediate links which lie therebetween are essentially on the surface of the sail and attached to the sail.

If the sails are rolled up on the shaft for reefing, a thick roll on the edge would result whenever the sails have a right-angled cross section, since here more layers of the comparatively thick boltrope lie over one another. As the sails of the present invention have lesser height internally or centrally than externally or at the corners, the boltropes are rolled up in the form of a screw, thereby reducing the thickness of the edges of the rolled up sails.

If the shaft has a screw-shaped groove for holding a part of the boltrope on reefing the sails on the shaft, this thickening becomes still smaller, especially on the longitudinal boltrope. As described above, this design has the advantage that the large transverse expansion of the boltrope, which is preferably in the yard, does not interfere with setting up the sails on the shaft.

Advantageously, devices to alter the bending of the yard can be provided. In this way, the sail qualities can be adapted especially well in different wind conditions and directions of the apparent wind. It should be mentioned that the alternative of the bending of a large beam is known (FR-OS 2 472 508); however, that is a limited bending only in the longitudinal direction of the beam. Morever, the curving of the yards should, above all, be variable, especially in the outermost third or quarter of the yard.

According to the invention, a further adaptation is possible. In that advantageous specific embodiment, the yards consist of at least two components which are arranged one behind the other, are in the shape of a rod and are attached. At least one of the components is flexible and at least one has a length which can be altered. If the length of the rod-shaped component of variable length is altered, the curvature of the yards are also changed.

According to an especially preferred specific embodiment, each yard has two anterior rod-shaped components arranged one over the other and a posterior rod-shaped component. The former are provided with grooves to receive the boltropes and are supplied with links while the latter consists of sections, which correspond to the sections between the links of the anterior rod shaped components, and devices such as pistons to alter the intervals of the sections.

If the spacing of the sections of the posterior rod-shaped components is altered, the buckling angle is altered between the spaced of the anterior rod-shaped components. In this way, the entire curving of the yard not only can be altered, but at specifically desired locations the cuvature can be influenced so that the yard profile can be adapted to a perfect profile. If three links are provided on each side of the yard, where at times the buckling angle can be changed by about two degrees, the entire curving angle of the yards can be increased about six degrees. If this curving angle was previously twelve degrees, a maximum angle of curvature of 18 degrees can be attained. Appropriately, it is provided that the curvature on the windward and leeward sides can be separately adjusted. If one sails hugging the wind, only the curvature on the windward side will be increased. If one sail in front of the wind, the yards on both sides will be bent more pronouncedly in order to maintain the best possible sailing in front of the wind by a suitable balloon-form of the sail. Understandably, the groove for holding the boltrope in the vicinity of the link must be correspondingly shaped, for example, with corresponding casings so that the boltrope of the sail is not clamped in the vicinity of the link.

The spacing of the sections of the posterior rod-shaped components and the curvature thereof can be quite easily adjusted by hydraulic piston/cylinder units. Moreover, for each link a separate hydraulic piston/-cylinder unit may be used.

The design for adjusting the distances can also be obtained by a lever attached to the shaft and by differential coils attached to the lever. For example, by turning only one shaft the bending of the single links can be variably adjusted at the same time that the levers is variably extended. A larger lever length corresponds then to a larger alteration of the curving angle to the corresponding link.

The devices for reefing and erecting the sail, for bracing and for altering the curving of the yards can be actuated electrically or hydraulically, whereby control devices for the electrical or hydraulic actuation can be arranged in a central location on the ship or in several central locations on the ship. It is accordingly no longer necessary, as has been the case up to now, to alter the location of the sail for reefing and erecting the sail directly to the mast, on which the location of the sail can be altered. In this way, the great number of seamen, which up to now have been necessary for service on a sailing ship, is no longer necessary, and above all enables the economical operation of such a sailing ship.

The invention is described by means of the following prefered specific embodiments with references to the attached drawings.

FIG. 3 is a further enlarged sectional view of a portion of FIG. 2 showing the shaft for erecting the sail;

FIG. 4 is a sectional view of a yard in which the devices for reefing and erecting the sail are schematically shown;

Figure 1:
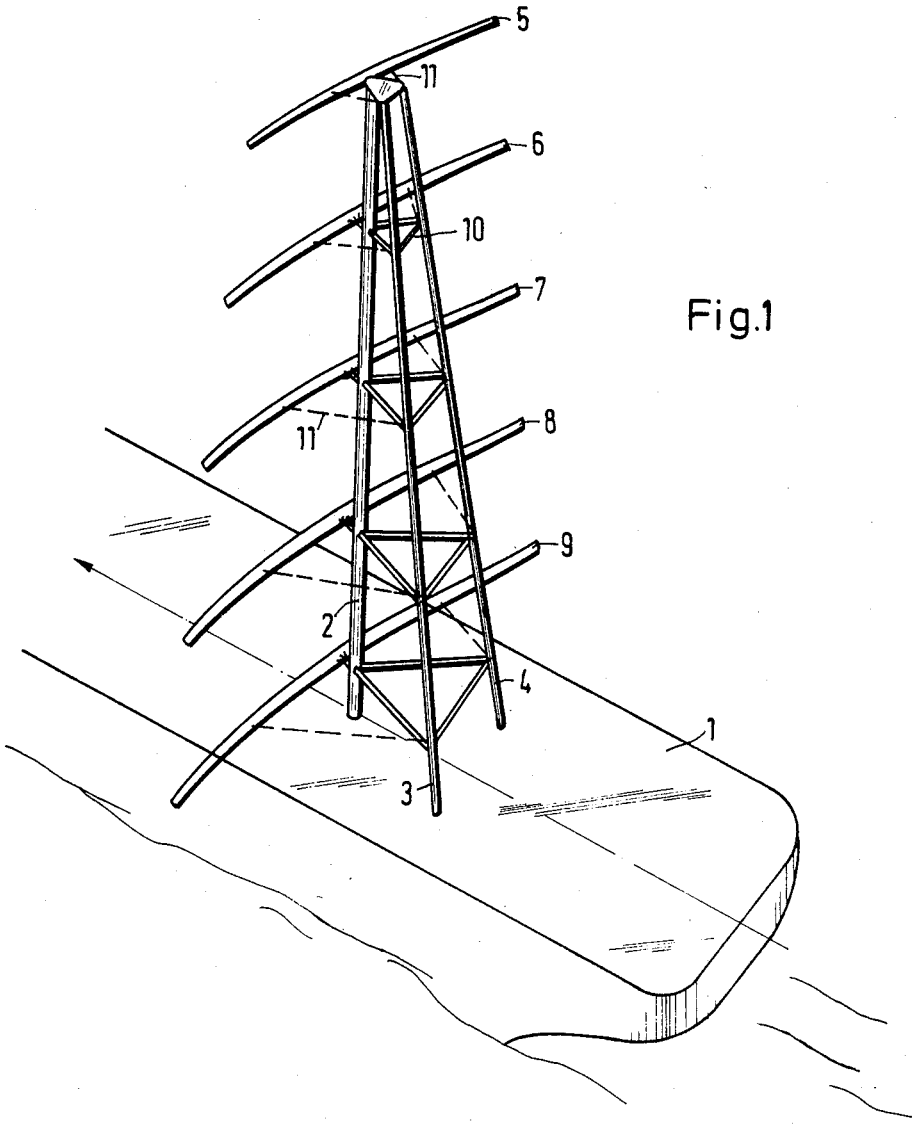
FIG. 1 is a perspective view, schematically illustrated, of a mast and the yards of a sailing ship according to the invention.

In FIG. 1 a boat body 1 of a sailing ship is shown schematically, the bow of which is assumed to be beyond the left edge of the drawing. Three rigid struts 2, 3, and 4, are rigidly mounted on the deck of the boat body 1, and secured to each other with strutting 10 at the elevations of each of the yards 5, 6, 7, 8 and 9 thereby reinforcing the tripod mast construction.

On the forward or anterior perpendicular strut 2, yards 5 to 9 are attached near their midpoint and are bent horizontally toward their free ends. The yards are braced with ropes 11 attached to the corresponding yards 5 to 9 as well as to each of the struts 3 and 4 which are located behind strut 2 and near one another on opposite sides of the boats' longitudinal axis. The whole mast with yards and bracing devices consists of a free standing unit; the ropes, wires or the like between the various masts do not need to be stretched. It is apparent that instead of only the one mast shown on the boat body 1, several masts with corresponding yards and devices can be arranged one behind the other.

Figure 2:
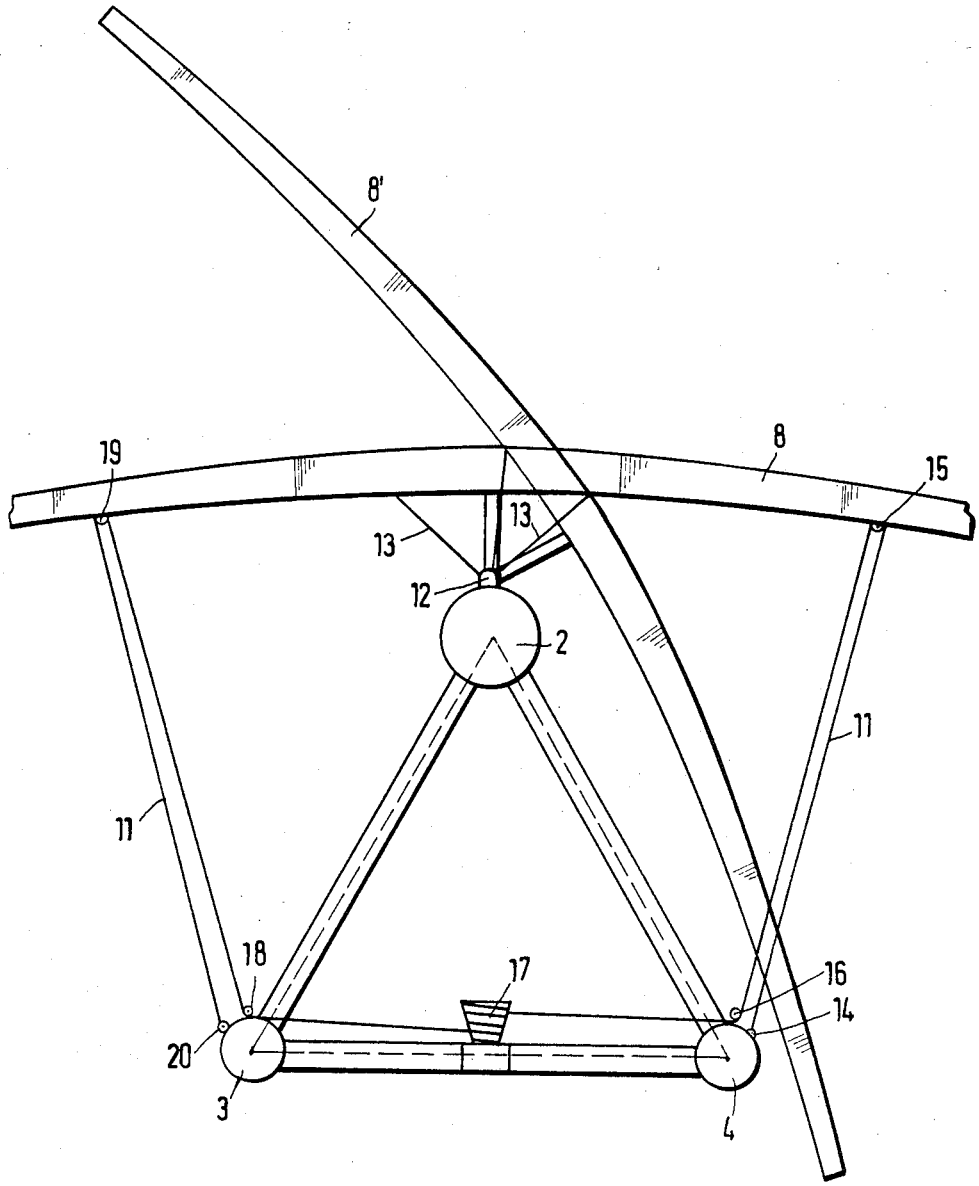
FIG. 2 is an enlarged horizontal cross sectional view slightly above one yard on the mast.

In FIG. 2, which shows a horizontal section through the mast slightly above one of the yards, for example, the yard 8, it will be noted the yard is rotatably attached to the anterior strut 2 of the mast. The yard is held by strutting 13 or similar devices at a distance from the mast strut 2. The bracing devices consist of a rope 11, one end of which is attached at 14 to the perpendicular mast strut 4. The rope 11 then passes around a roller 15 on the yard 8, a roller 16 on the mast strut 4, and is wound a few times around a winch 17. It then passes around a roller 18 on the mast strut 3 and a roller 19, which in turn is provided on yard 8. The other end of this rope 11 is attached at 20 to the mast strut 3. As can easily be seen in FIG. 2, the yard 8 can be braced by the rope 11 and the winch can be driven, for example, electrically or hydraulically. For emergencies, an additional hand drive can also be provided for the winch 17.

If the winch is driven in one direction, rope 11 on the right, for example, is pulled and fed to the left. In this way, the yard is braced in place clockwise, as shown schematically at 8' indicating the very large bracing angle which can be attained in the sailing ship of the present invention. If winch 17 is driven in the other direction, the bracing results in the opposite direction.

In FIG. 3, which shows a portion of FIG. 2, a shaft 21 is shown in front of mast strut 2 and attached between the yards for rolling up the halves 22*a* and 22*b* of the sail. The shaft 21 has an elongated or elliptical shaped cross section so that, in the position shown, its greatest longitudinal extension is in the direction of a tangent to the curved face of the yards. Shaft 21 is rotatable around a vertical axis at 42 and can be turned by a hydraulic or electric motor (not shown), and also by hand actuation in an emergency.

Sail portions 22*a* and 22*b* are attached to diametrically opposite locations of the shaft 21 such that the sail can be reefed by the shaft 21 being turned, whereby the sail is rolled up.

The mechanism for achieving this is shown in more detail in FIG. 4. Pulleys 23 are attached above and below on shaft 21 and rope 24 is wound therearound with a few turns, by which the sail can be erected. These ropes 24 extend to near the outer ends of the yard 8, are wound around a roller 25 and are attached at 26 to the corresponding half of the sail. If the shaft is turned in one direction, both sail halves 22*a* and 22*b* are rolled up, while the rope 24 is extended. The roller 25 is secured by a spring 36 so that the rope 24 is always biased toward a rigid condition. If the direction of rotation of the shaft 21 is reversed, the rope 24 on both sides of the yard is shortened by accumulation on the pulley, whereby the sail halves are pulled away from erecting shaft 21.

The upper boltropes 48 of the sail are held in a screw-shaped groove 51 on the inboard portion of pulley 23 upon being rolled up on the shaft, the illustration of which shows the sail 22*a* in part broken away.

Understandably, the sails do not have to be completely reefed or completely erected. During a storm, in between positions are possible, whereby the shaft is appropriately turned just so far that its greatest longitudinal extension assumes the direction of the tangent to the yards, as shown in FIG. 3, so that the shaft 21 creates the least possible additional wind resistance.

Figure 5:
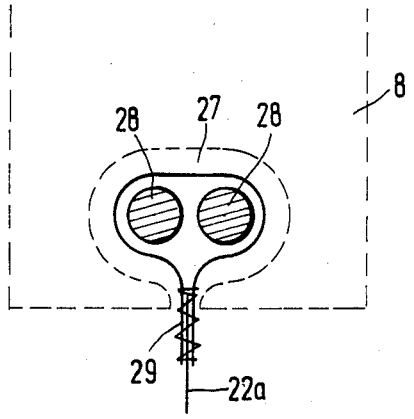
FIG. 5 is a cross section of one boltrope for a sail, which is preferably used on the sailing ship according to the invention.

In FIG. 5, longitudinal groove 27 in yard 8 shown by a broken line, holds boltrope 28 of the sail for erecting and reefing the sail. The boltrope is so arranged that two ropes 28 are positioned next to each other and not just one rope as is customary. The edge area of the sail 22*a* is laid around both ropes 28 and is sewn at 29.

Figure 6:
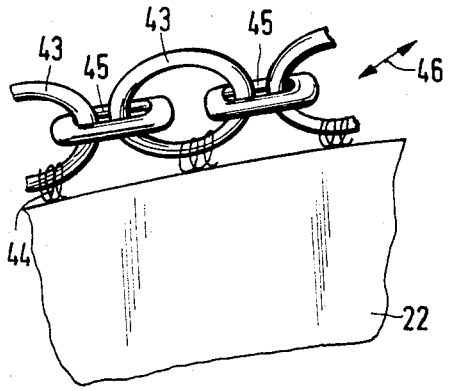
FIG. 6 is a detailed representation of another embodiment of a boltrope.

In FIG. 6, another embodiment of a boltrope is shown. The boltrope is in the form of a link chain in which the surfaces of the links of the chain are alternatingly perpendicular to one another. Every second chain link 43, which extends essentially coplanar with the surface of the sail 22, is attached; e.g., sewn, to the sail at 44. The chain links 45 lying in between links 43 extend in a plane (see arrow 46) essentially perpendicular to the sail and are securely retained by the groove 27.

Figure 7:
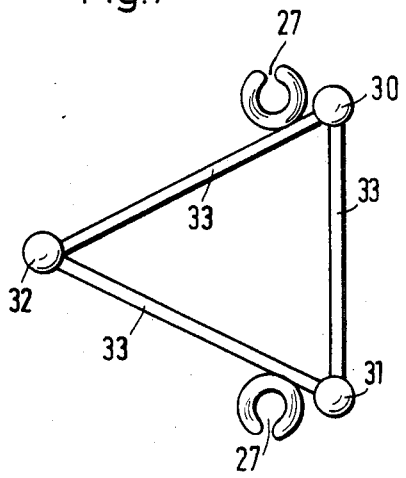
FIG. 7 is a vertical cross section of another specific embodiment of a yard.
Figure 8:
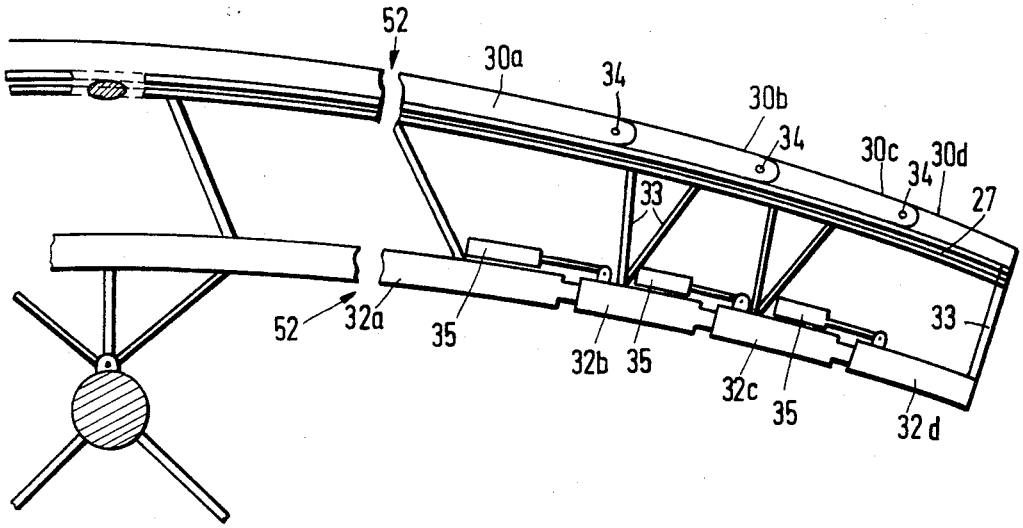
FIG. 8 is a top view of the yard of FIG. 7.

In FIGS. 7 and 8 there is shown by an especially advantageous specific embodiment of the yard. The yard consists of three rod-shaped components 30, 31 and 32, which are arranged essentially parallel to one another in a triangular pattern. Two of the rod-shaped components; i.e., the rod-shaped components 30 and 31, are arranged one above the other, the third rod-shaped component 32 is half-way between rod components 30 and 31 and behind them. The rod-shaped components 30, 31, and 32 are attached by supports 33.

FIG. 8 shows the central and outer parts of a yard. Approximately one-third of its length is not shown in the drawing as designated at 52. As the drawing shows, the upper rod-shaped component 30, and correspondingly the lower rod-shaped component 31, consists of sections 30*a*, 30*b*, 30*c*, and 30*d*, which are attached at their connecting points with pivotal links 34. Groove 27 is located behind these sections for the boltrope of the sail. This groove is arranged in a correspondingly flexible holder or in such a holder that it also does not lose its guiding characteristics if the sections 30*a* to 30*d* bend around the links 34 at a relatively small angle.

The bending also affects the rod-shaped components 32 consisting of sections 32*a*, 32*b*, 32*c* and 32*d*, which correspond to sections 30*a* to 30*d* of the anterior rod-shaped components. The individual sections 32*a* to 32*d* are connected together telescopically in such a way that one portion of a component can penetrate at various depths into the one next to it, for example, by a plug of one that can penetrate at various depths into a corresponding bore of its adjacent component. The depth of this penetration and the penetration distance of sections 32*a* to 32*d* are varied by the piston/cylinder units 35. By altering the distances of components 32*a* to 32*d* the curving of the yard is changed in order to maintain the best possible adaptation of the sails to the predominant wind conditions.

Figure 9:
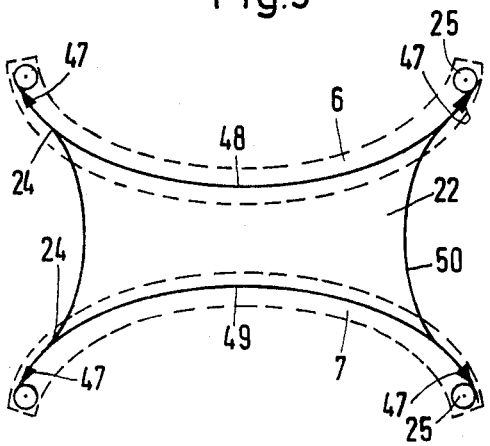
FIG. 9 is a schematic illustrating of the forces exerted when erecting and reefing the sail.

In FIG. 9, the shape of the sail 22 is schematically shown as used in accordance to the invention. This sail is acted upon by traction, in the direction of the arrows 47, by wires or ropes 24, with which the sail is erected and spread. Although this is exaggerated in the drawing, it is known that these forces spread not only the upper and lower boltropes 48, 49 but also the exterior or side boltropes 50. In this manner, the whole sail will be more or less spread uniformly. The boltropes are especially stretched because the ropes 24 are fully stretched, the guide pulleys 25 are always at a distance from the sail, and due to the bending of the yard as indicated by dotted lines at 6 and 7, the pulleys are also farther apart than would be the case with conventional guide pulleys.

What is claimed is:

1. A sailing ship (1) having at least one tripod-like mast rigidly attached thereto, said mast comprising interconnected struts (2, 3, 4), two of which straddle the longitudinal axis of the ship with the third strut arranged between and in front of the two straddling struts;

curved yards (5–9) pivotally attached to said mast;

bracing means (11–20) cooperatively interconnecting the yards attached to said mast for controlling the pivotal movement of the yards;

an actuating shaft (21) arranged at the mid-section of the yards (5–9) and extending between adjacent yards for reefing a sail (22) spread between those yards;

sail erection means attached to the sail on opposed sides at the upper and lower corners of the sail and extending generally in the direction of the longitudinal extension of the yards, said yards having longitudinal grooves (27);

upper and lower boltrope means for a sail held in the grooves; and a sail having a lesser width in the central portion than at the top and bottom thereof and a lesser height in the central portion than on the edges thereof.

2. The sailing ship of claim 1 wherein said yards are provided with guide means (25) adjacent the ends thereof for controlling the sail erection means, the guide means being spaced by a distance greater than the length of said boltrope means.

3. The sailing ship of claim 1 wherein the actuating shaft has essentially an elliptical cross section with the large principal axis of the ellipse being parallel to a tangent to the curved yards at the location of the shaft.

4. The sailing ship of claim 1 wherein the actuating shaft is provided with a ridigly attached pulley (23) operatively connected with the sail erection means during erection and reefing of the sail and biasing means cooperating with the sail erection means for maintaining the sail erection means in a taut condition.

5. The sailing ship of claim 1 wherein the boltrope means held in the grooves have a major cross sectional dimension perpendicular to the surface of the sail.

6. The sailing ship of claim 1 wherein the boltrope means held in the grooves are link chains having components alternating in two perpendicular planes with one component being essentially coplanar with and attached to the sail.

7. The sailing ship of claim 1 wherein the actuating shaft has a screw-shaped groove (51) for receiving a portion of the boltrope means for rolling the sail on the shaft.

8. The sailing ship of claim 1 wherein at least one of the yards includes means for changing the longitudinal curvature of the yard.

9. The sailing ship of claim 8 wherein the means for changing the curvature of the yard is adjacent the end of the yard and permits variable changes in the curvature of the yard.

10. The sailing ship of claim 1 wherein at least one of the yards consists of at least two rod-shaped components (30, 32) which are arranged one behind the other, at least one of which is bendable and one of which is of variable length.

11. The sailing ship of claim 10 including means (35) for varying the length of the rod-shaped component.

12. The sailing ship of claim 11 wherein the means for varying the length is a hydraulic unit having an actuating rod; the variable length component includes sections and the actuating rod is attached to the sections.

13. The sailing ship of claim 1 wherein each yard has two anterior rod-shaped components (30, 31) arranged one above the other and a groove 27 for holding each boltrope means, the rod-shaped components being provided with links (34), the yard having a posterior rod-shaped component (32) comprised of sections which variably control the length of the posterior rod-shaped component.

14. The sailing ship according to claim 1 wherein the actuating shaft for reefing and erecting the sail and the bracing means for altering the pivotal position of the adjacent yards are actuated electrically.

15. The sailing ship according to claim 1 wherein the actuating shaft for reefing and erecting the sail and the bracing means for altering the pivotal position of the adjacent yards are actuated hydraulically.

* * * * *